US005580317A

United States Patent [19]

Yun

[11] Patent Number: 5,580,317

[45] Date of Patent: Dec. 3, 1996

[54] SWING ADJUSTING TO UPWARD ITS LEVEL

[76] Inventor: Young-Kwan Yun, 864-31 BangBae-Dong, SeoCho-Ku, Seoul, Rep. of Korea

[21] Appl. No.: 520,942

[22] Filed: Aug. 31, 1995

[30] Foreign Application Priority Data

Jan. 28, 1995 [KR] Rep. of Korea ..... 95-1755

[51] Int. Cl.[6] ..... A63G 9/16

[52] U.S. Cl. ..... 472/120; 472/118

[58] Field of Search ..... 472/118, 120, 472/121, 122, 124

[56] References Cited

U.S. PATENT DOCUMENTS 3,171,653 3/1965 Pacuk ..... 472/120

4,155,548 5/1979 Smith et al. ..... 472/120

*Primary Examiner*—Kien T. Nguyen

*Attorney, Agent, or Firm*—Lowe, Price, LeBlanc & Becker

[57] ABSTRACT

A swinger's position elevatory swing is disclosed. The swing lets manual and mechanical elevation of swinger's position by swinger's feet or hands at about the highest position of the swinger and thereby increasing the swinging times due to increased potential energy of the sitting board loaded with the swinger. A fixed sitting board is fixed to the swing ropes and has an arcuate hollow guide pipe and a fixing pipe. A movable sitting board is coupled to the fixed board and has an arcuate slide bar, engaging with the guide pipe of the fixed board, and a support bar. The support bar is pivoted to the fixing pipe of the fixed board by a pivot pin. The length ratio of the opposed portions of the support bar about its moment action point is about 2:3.

3 Claims, 2 Drawing Sheets

SWING ADJUSTING TO UPWARD ITS LEVEL

BACKGROUND OF THE INVENTION

1. Field of the Invention

The present invention relates in general to swings and, more particularly, to a structural improvement in such swings for letting manual elevation of swinger's position on a sitting board by small force during swinging and thereby increasing the swinging times due to increased potential energy of the sitting board loaded with the swinger.

2. Description of the Prior Art

In order to swing typical swings installed in, for example, a playground, swingers on the sitting board of the swings either kick away off the ground several times or are repeatedly pushed or pulled by another person. However, it is somewhat difficult for the swingers to kick away off the ground during swinging as the swingers are typically children and, in this regard, the child swingers are tired of swinging due to the difficult kicking motion. Another problem of the typical swings is resided in that a physically handicapped person can not swing alone.

SUMMARY OF THE INVENTION

It is, therefore, an object of the present invention to provide a swinger's position elevatory swing in which the problems can be overcome and which lets manual and mechanical elevation of swinger's position on a sitting board by swinger's feet or hands at about the highest position of the swinger and thereby increasing the swinging times due to increased potential energy of the elevated swinger's position.

In order to accomplish the above object, the present invention provides a swinger's position elevatory swing comprising: a fixed sitting board fixed to swing ropes and having a generally rectangular first support frame with a pair of rope fixing loops, an arcuate hollow guide pipe with a pair of guide balls, and a fixing pipe with both a pivot slit and a first pivot hole; a movable sitting board coupled to the fixed board and having a generally rectangular second support frame with opposed standing hooks, an arcuate slide bar extending down from the front center of the second frame, and a support bar with a second pivot hole, the support bar being pivoted to the fixing pipe of the fixed board by means of a pivot pin passing through the pivot holes; and a pair of guide chains for preventing possible excessive elevation of the movable sitting board, each of the guide chains having an upper guide hook and a lower guide hook, both guide hooks being connected to each other by means of a connection ring.

In a preferred embodiment of this invention, the length ratio of the opposed portions of the support bar about its moment action point is about 2:3.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
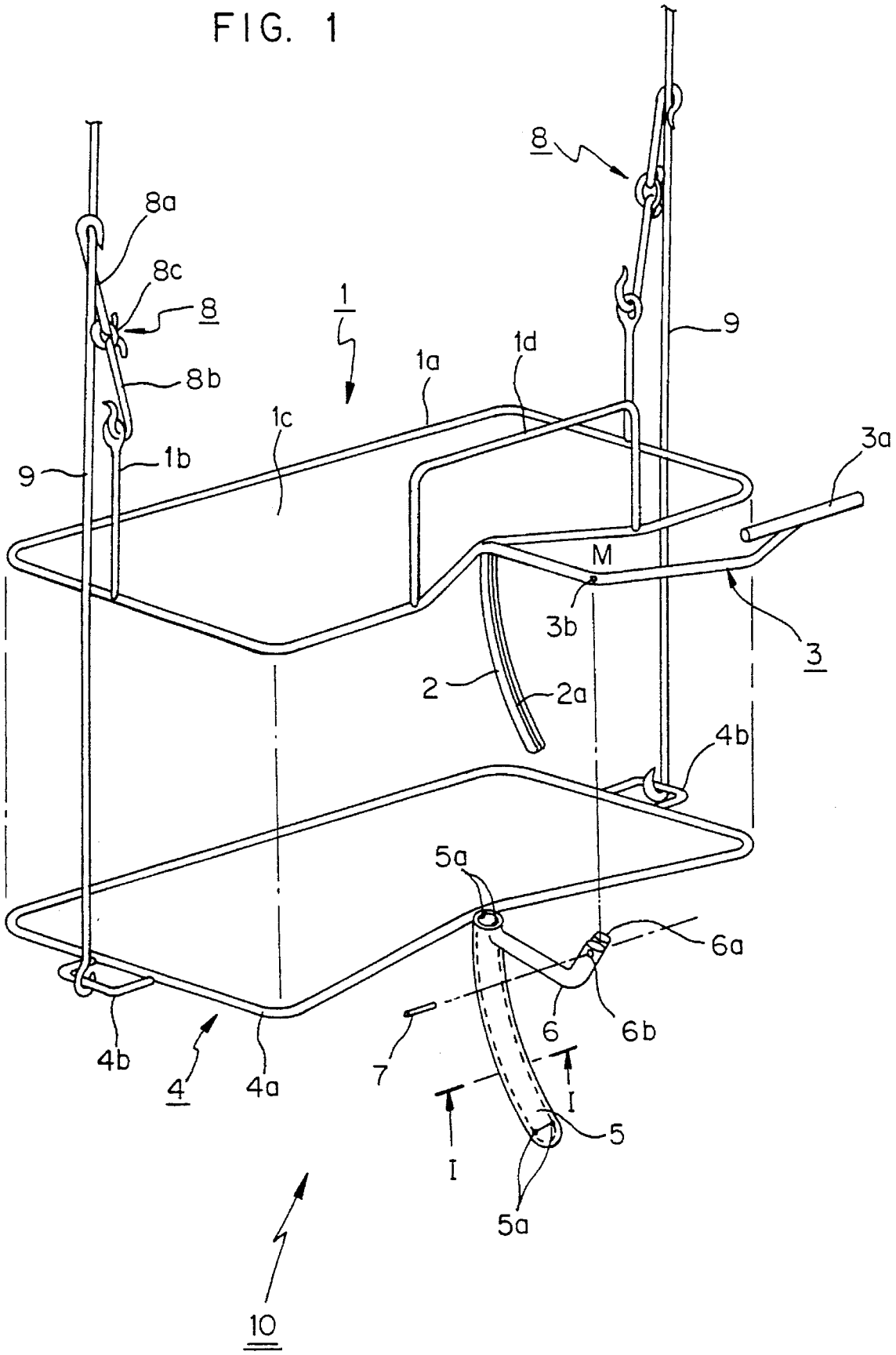
FIG. 1 is an exploded perspective view of a swinger's position elevatory swing of the present invention.
Figure 2:
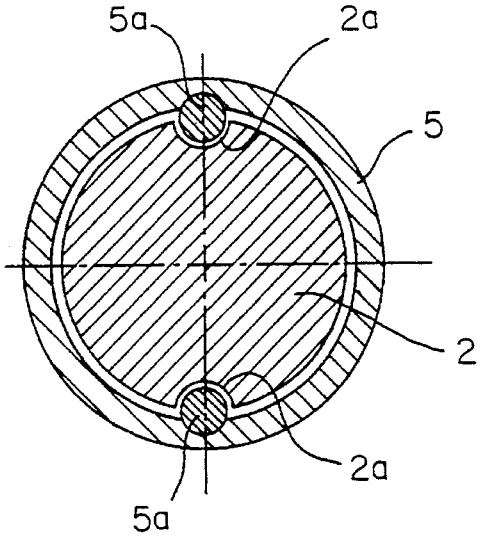
FIG. 2 is a sectional view showing a slide bar inserted in a hollow guide pipe taken along the section line I—I of FIG. 1.
Figure 3:
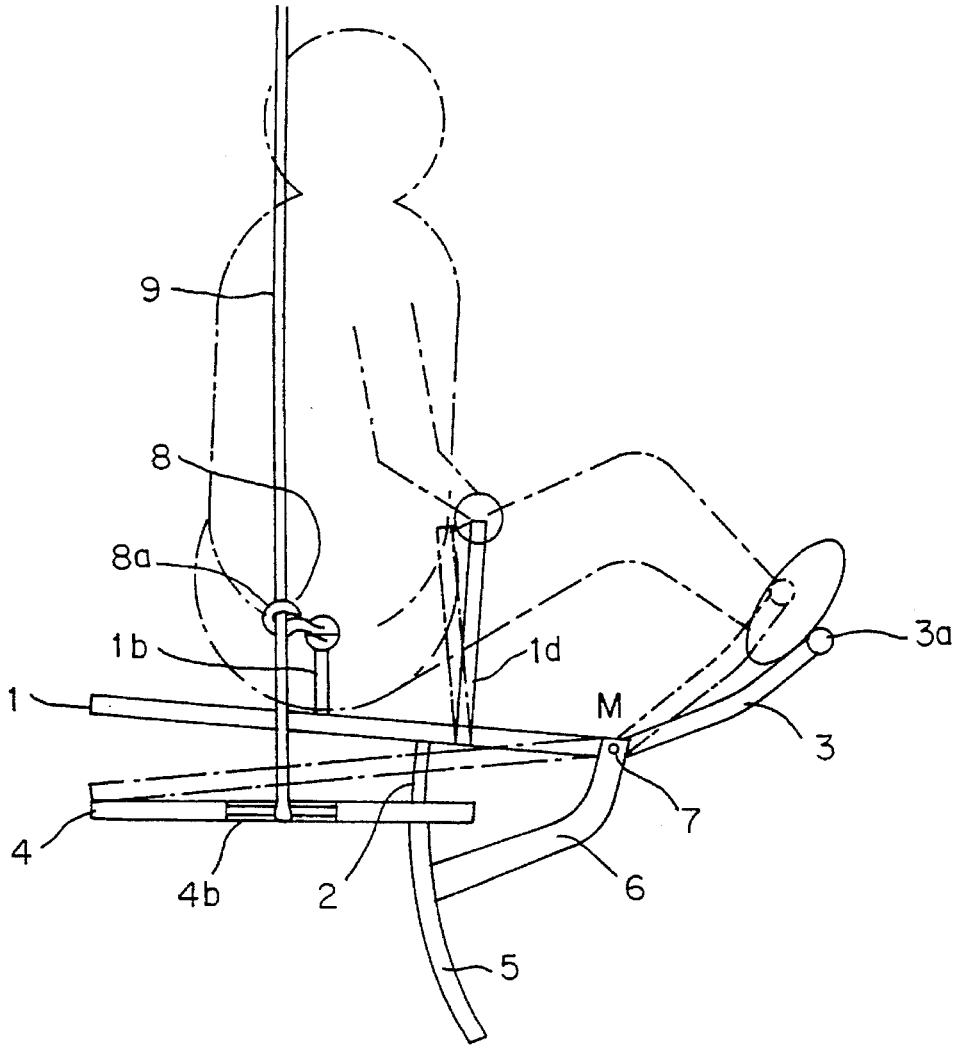
FIG. 3 is a side view showing both a normal position (in the phantom line) and an elevated position (in the solid line) of a movable sitting board of the swing of this invention.

FIG. 1 is an exploded perspective view of a swinger's position elevatory swing of the present invention. As shown in this drawing, the swing 10 of this invention includes a fixed sitting board 4 whose opposed shorter sides are fixed to the swing ropes 9. Above the fixed sitting board 1, a movable sitting board 1 is coupled to the fixed board 4. The swing 10 also includes a pair of guide chains, that is, left and right guide chains 8 for preventing possible excessive elevation of the movable board 1. Each of the guide chains 8 comprises an upper guide hook 8*a* and a lower guide hook 8*b*, which hooks 8*a* and 8*b* are connected to each other by means of a connection ring 8*c*.

The fixed sitting board 4 connected to the swing ropes 9 comprises a generally rectangular support frame 4*a* whose front is depressed into a predetermined bending shape. The opposed shorter sides of the frame 4*a* have their fixing loops 4*b* for knotting the swing ropes 9 to the sides of the frame 4*a*. An arcuate hollow guide pipe 5, adapted for guiding a sliding motion of a slide bar 2 described later herein, is welded, at its top end, to the depressed portion of the support frame 4*a*. The hollow guide pipe 5 receives a pair of guide balls 5*a* such that the balls 5*a* are opposed to each other in the pipe 5. An L-shaped fixing pipe 6 with one inflection point is welded to the top section of the guide pipe 5. The fixing pipe 6 has a pivot slit 6*a*, which slit 6*a* is formed by longitudinally slitting the center of the distal end of the pipe 6 to a given depth. A pivot hole 6*b* is transversely formed in the distal end of the fixing pipe 6 such that the hole 6*b* is perpendicular to the slit 6*a*.

The movable sitting board 1 coupled to the fixed board 4 comprises a generally rectangular support frame 1*a*, the front center of which frame 1*a* is depressed into a predetermined bending shape. The opposed shorter sides of the support frame 1*a* have their standing hooks 1*b* with loops, which loops of the hooks 1*b* are for connecting the hooks 1*b* to the lower hooks 8*b* of the guide chains 8. A reversed U-shaped safety guide 1*d* is welded to the bent front center of the frame 1*a* such that the guide 1*a* stands on the front center of the frame 1*a*. The movable board 1 also includes the arcuate slide bar 2 extending down from the front center of the frame 1*a*. The arcuate slide bar 2 is provided with longitudinal guide grooves 2*a* formed on the opposed side surfaces of the bar 2. A support bar 3, which has a predetermined bending shape with two inflection points, extends from the front center of the frame 1*a* forward. The movable board 1 further includes a sitting panel 1*c* held by the frame 1*a*.

A pivot hole 3*b* is transversely formed in the first inflection point or in a moment action point M of the support bar 3. In order to increase the moment of the bar 3, it is preferred to let the length ratio of the opposed portions of the bar 3 about the point M be about 2:3. A foot holder 3*a* is transversely fixed to the distal end of the support bar 3 and adapted for forcing the movable board 1 by the swinger's feet or hands.

In the present invention, it should be understood that the support bar 3 may be appropriately bent about its moment action point M such that a swinger, in particular, a physically handicapped person, easily pushes down the bar 3 by one hand so as to elevate the swinger's position on the movable board 1.

In order to assemble the parts into the swing, the arcuate slide bar 2 of the movable board 2 is slidably inserted into the guide pipe 5 of the fixed board 4. Thereafter, the moment action point M of the support bar 3 of the movable board 1 is placed in the pivot slit 6*a* of the fixing pipe 6 of the fixed board 4 prior to pivoting of the point M to the slit 6*a* by means of pivot pin 7 passing through the pivot holes 3*b* and 6*b*. The pivoting of the support bar 3 to the fixing pipe 6 is followed by fixing of the swing ropes 9 to the opposed fixing loops 4*b* of the fixed board 4. Thereafter, each guide chain 8 is coupled to its associated swing rope 9 and to its associated standing hook 1*b* at its both hook ends so as to prevent possible rocking and separation of the movable board 1 in the elevated position of the board 1.

After assembling of the parts into the swing, a swinger other than a physically handicapped person sits on the sitting panel 1*c* of the movable board 1 and passes the legs through the safety guide 1*d*, and typically swings while gripping the safety guide 1*d*. In order to increase the swinging times of the swing 10 in the above state, the swinger places the feet on the foot holder 3*a* of the support bar 3 and forcibly pushes down the holder 3*a* so that the foot pushing force acting on the holder 3*a* seesaws and elevates the movable board 1 along with the swinger about the moment action point M.

In the case of physically handicapped swinger, the swinger sitting on the sitting panel 1*c* of the movable board 1 grips the safety guide 1*d* and the holder 3*a* of the support bar 3 by both hands and forcibly pushes down the holder 3*a* by the hand so that the hand pushing force acting on the holder 3*a* seesaws and elevates the movable board 1 along with the swinger about the moment action point M in the same manner as described above.

As the length ratio of the opposed portions of the bar 3 about the point M is about 2:3 as described above, the moment acting on the bar 3 is larger than the pushing force acting on the holder 3*a*. In addition, there is a gap between the longitudinal guide grooves 2*a* of the slide bar 2 and the guide balls 5*a* in the guide pipe 5 so that frictional resistance is scarcely generated in the slide motion of the slide bar 2 in the guide pipe 5. With the above specified length ratio (2:3) of the support bar 3 as well as the smooth slide motion of the slide bar 2 in the guide pipe 5, the movable board 1 along with the swinger can be smoothly elevated overcoming the inverse moment acting on the moment action point M of the bar 3 by the total weight of the board 1 loaded with the swinger.

When the movable board 1 along with the swinger is forcibly elevated as described above, the length of the swing ropes 9 is shortened. The swinging effect of the swing with the shortened ropes will be increased in the same manner as the case of shortening of rope of a typical single pendulum motion in order to increase swinging times and swinging speed. The swinging times of the swing 10 with the shortened swing ropes 9 are thus increased. Of course, the swinging times and the swinging speed of the swing 10 will be reduced with the lapse of time. In this case, the movable board 1 is returned to its original position or to its lower position by removing the feet from the holder 3*a* of the bar 3 and, thereafter, the above-described process for elevating the swinger's position is repeated so as to increase the swinging effect.

As described above, the present invention provides a swing having a movable board, selectively elevating the swinger's position by the swinger's pushing force, and a fixed board fixed to swing ropes. The swinger sitting on the movable board selectively elevates the movable board in the case of reduced swinging times and reduced swinging speed, thus to shorten the swing ropes and to increase the swinging effect of the swing in the same manner as the case of shortening of rope of a typical single pendulum motion in order for increasing the swinging times and the swinging speed. In this regard, the swing of this invention lets the swingers, in particular, child swingers or physically handicapped swingers, easily repeatedly swing without addition of another person. Another advantage of this invention is resided in that the swing needs no repeated ground kicking motion differently from the typical swings so that this swing makes the swingers not tired of swinging.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A swinger's position elevatory swing comprising:

a fixed sitting board fixed to swing ropes at its opposed sides, said fixed board including:

a generally rectangular first support frame having a front and opposed sides, said first support frame being depressed into a predetermined bended shape and provided at said opposed sides with fixing loops for knotting the swing ropes to said opposed sides of said first frame;

an arcuate hollow guide pipe for guiding a slide motion of an arcuate slide bar of a movable sitting board, said guide pipe extending from the depressed portion of said first support frame; and an L-shaped fixing pipe fixed to said guide pipe and provided with both a pivot slit and a first pivot hole, said pivot slit being formed by longitudinally slitting the center of distal end of the fixing pipe to a given depth, and said first pivot hole being perpendicular to the pivot slit;

a movable sitting board coupled to and above the fixed board, said movable board including:

a generally rectangular second support frame having a front center and opposed sides, said second support frame being depressed into a predetermined bended shape and provided at said opposed sides with standing hooks connected to associated guide chains;

a reversed U-shaped safety guide fixed to the depressed front of the second support frame such that the safety guide stands on the front of the second frame;

an arcuate slide bar extending down from the front center of the second frame;

a support bar having a predetermined bended shape and extending forward from the front center of the second frame, said support bar having a second pivot hole and being pivoted to said fixing pipe of the fixed board by means of a pivot pin passing through the first and second pivot holes; and a sitting panel held by the second frame;

the guide chains preventing possible excessive elevation of the movable sitting board, each of said guide chains having an upper guide hook and a lower guide hook, both guide hooks being connected to each other by means of a connection ring and also respectively connected to an associated swing rope and to an associated standing hook of the second support frame.

2. The swing according to claim 1, wherein the length ratio of the opposed portions of said support bar about its moment action point is about 2:3.

3. The swing according to claim 1, wherein said guide pipe of the fixed sitting board receives a pair of guide balls such that the guide balls are opposed to each other in the guide pipe, and said arcuate slide bar is provided with longitudinal guide grooves for engaging with the guide balls of the guide pipe.

* * * * *